US012336635B2

(12) United States Patent
Negus et al.

(10) Patent No.: US 12,336,635 B2
(45) Date of Patent: Jun. 24, 2025

(54) MATTRESS COVERING

(71) Applicant: Sleep Number Corporation, Minneapolis, MN (US)

(72) Inventors: Natalie Negus, Minneapolis, MN (US); Antony Kirk, Minnetonka, MN (US)

(73) Assignee: Sleep Number Corporation, Minneapolis, MN (US)

( * ) Notice: Subject to any disclaimer, the term of this patent is extended or adjusted under 35 U.S.C. 154(b) by 1076 days.

(21) Appl. No.: 16/731,577

(22) Filed: Dec. 31, 2019

(65) Prior Publication Data

US 2020/0375369 A1 Dec. 3, 2020

Related U.S. Application Data

(60) Provisional application No. 62/856,458, filed on Jun. 3, 2019.

(51) Int. Cl.

| | |
|---|---|
| ***A47G 9/02*** | (2006.01) |
| ***A47C 27/00*** | (2006.01) |
| ***A47C 31/00*** | (2006.01) |
| ***A47C 31/10*** | (2006.01) |
| ***D03D 15/56*** | (2021.01) |

(52) U.S. Cl.

CPC ..... *A47C 27/002* (2013.01); *A47C 31/00* (2013.01); *A47C 31/105* (2013.01); *A47G 9/0246* (2013.01); *D03D 15/56* (2021.01); *D10B 2505/08* (2013.01)

(58) Field of Classification Search

CPC .... A47G 2009/02; A47G 9/02; A47G 9/0246; A47C 27/002; A47C 31/00; A47C 31/105; D10B 2505/08; D03D 15/56

See application file for complete search history.

(56) References Cited

U.S. PATENT DOCUMENTS

| | | | |
|---|---|---|---|
| 2,639,444 | A | 5/1953 | Monsabert |
| 4,757,564 | A | 7/1988 | Goodale |
| 4,766,628 | A | 8/1988 | Greer et al. |
| 4,788,729 | A | 12/1988 | Greer et al. |
| D300,194 | S | 3/1989 | Walker |
| 4,829,616 | A | 5/1989 | Walker |
| 4,890,344 | A | 1/1990 | Walker |
| 4,897,890 | A | 2/1990 | Walker |

(Continued)

FOREIGN PATENT DOCUMENTS

| | | |
|---|---|---|
| TW | M372126 | 1/2010 |

OTHER PUBLICATIONS

International Preliminary Report on Patentability in International Appln. No. PCT/US2019/069097, mailed Dec. 16, 2021, 8 pages.

(Continued)

*Primary Examiner* — Justin C Mikowski

*Assistant Examiner* — Ifeolu A Adeboyejo

(74) *Attorney, Agent, or Firm* — Fish & Richardson P.C.

(57) ABSTRACT

A bed has a mattress with a mattress top, a mattress bottom, and a mattress perimeter. The mattress includes a mattress cover surrounding the mattress. The mattress cover includes a first stretch fabric around the mattress perimeter of the mattress. The first stretch fabric has a first predominant stretch direction that is stretchable in a direction parallel to the mattress top. A multidirectional stretch fabric is positioned on the mattress top.

24 Claims, 10 Drawing Sheets

(56) References Cited

U.S. PATENT DOCUMENTS 4,908,895 A 3/1990 Walker
4,962,546 A 10/1990 Vitale
D313,973 S 1/1991 Walker
4,985,953 A * 1/1991 Seago ..... A47C 31/105 5/497
4,991,244 A 2/1991 Walker
5,127,115 A * 7/1992 Williams ..... A47G 9/0246 112/475.08
5,144,706 A 9/1992 Walker et al.
5,170,522 A 12/1992 Walker
5,249,322 A * 10/1993 Seago ..... A47G 9/0246 112/475.08
D368,475 S 4/1996 Scott
5,509,154 A 4/1996 Shafer et al.
5,564,140 A 10/1996 Shoenhair et al.
5,603,132 A 2/1997 Zafiroglu
5,636,393 A * 6/1997 Zafiroglu ..... A47G 9/0246 428/102
5,642,546 A 6/1997 Shoenhair
5,652,484 A 7/1997 Shafer et al.
5,765,246 A 6/1998 Shoenhair
5,903,941 A 5/1999 Shafer et al.
5,904,172 A 5/1999 Gifft et al.
6,006,383 A 12/1999 Pile et al.
6,037,723 A 3/2000 Shafer et al.
6,108,844 A 8/2000 Kraft et al.
6,161,231 A 12/2000 Kraft et al.
6,199,231 B1 * 3/2001 Zafiroglu ..... D04B 21/18 5/497
6,202,239 B1 3/2001 Ward et al.
6,272,701 B1 8/2001 Zafiroglu
6,397,419 B1 6/2002 Mechache
6,463,606 B2 10/2002 Barker et al.
6,483,264 B1 11/2002 Shafer et al.
6,686,711 B2 2/2004 Rose et al.
6,708,357 B2 3/2004 Gaboury et al.
6,763,541 B2 7/2004 Mahoney et al.
6,804,848 B1 10/2004 Rose
6,832,397 B2 12/2004 Gaboury
D502,929 S 3/2005 Copeland et al.
6,883,193 B2 4/2005 Brooks et al.
6,883,191 B2 5/2005 Gaboury et al.
7,389,554 B1 6/2008 Rose
7,398,570 B2 7/2008 Seago
7,865,988 B2 1/2011 Koughan et al.
8,336,369 B2 12/2012 Mahoney
8,444,558 B2 5/2013 Young et al.
D691,118 S 10/2013 Ingham et al.
D697,874 S 1/2014 Stusynski et al.
D698,338 S 1/2014 Ingham
D701,536 S 3/2014 Sakal
8,672,853 B2 3/2014 Young
8,769,747 B2 7/2014 Mahoney et al.
8,893,339 B2 11/2014 Fleury
8,931,329 B2 1/2015 Mahoney et al.
8,966,689 B2 3/2015 McGuire et al.
8,973,183 B1 3/2015 Palashewski et al.
8,984,687 B2 3/2015 Stusynski et al.
8,997,280 B1 * 4/2015 Hannula ..... A47C 31/105 5/500
D737,250 S 8/2015 Ingham et al.
9,131,781 B2 9/2015 Zaiss et al.
9,370,457 B2 6/2016 Nunn et al.
9,392,879 B2 7/2016 Nunn et al.
9,510,688 B2 12/2016 Nunn et al.
9,635,953 B2 5/2017 Nunn et al.
9,730,524 B2 8/2017 Chen et al.
9,737,154 B2 8/2017 Mahoney et al.
9,770,114 B2 9/2017 Brosnan et al.
D809,843 S 2/2018 Keeley et al.
D812,393 S 3/2018 Karschnik et al.
9,924,813 B1 3/2018 Basten et al.
10,058,467 B2 8/2018 Stusynski et al.
10,092,242 B2 10/2018 Nunn et al.
10,143,312 B2 12/2018 Brosnan et al.
10,149,549 B2 12/2018 Erko et al.
10,182,661 B2 1/2019 Nunn et al.
10,194,752 B2 2/2019 Zaiss et al.
10,194,753 B2 2/2019 Fleury et al.
10,201,234 B2 2/2019 Nunn et al.
10,251,490 B2 4/2019 Nunn et al.
10,342,358 B1 7/2019 Palashewski et al.
2004/0172754 A1 * 9/2004 Brooks ..... A47C 27/002 5/737
2008/0077020 A1 3/2008 Young et al.
2009/0044338 A1 2/2009 Rock et al.
2009/0144900 A1 6/2009 Marrache
2009/0193584 A1 * 8/2009 Stewart ..... D03D 15/56 5/495
2011/0144455 A1 6/2011 Young et al.
2012/0255120 A1 10/2012 Poston et al.
2012/0260424 A1 * 10/2012 Agarwall ..... A47G 9/0246 493/393
2014/0250597 A1 9/2014 Chen et al.
2014/0259418 A1 9/2014 Nunn et al.
2014/0277822 A1 9/2014 Nunn et al.
2015/0007393 A1 1/2015 Palashewski
2015/0025327 A1 1/2015 Young et al.
2015/0182397 A1 7/2015 Palashewski et al.
2015/0182399 A1 7/2015 Palashewski et al.
2015/0182418 A1 7/2015 Zaiss
2016/0073798 A1 * 3/2016 Pawlikowski ..... A47G 9/0246 297/219.1
2016/0100696 A1 4/2016 Palashewski et al.
2016/0242562 A1 8/2016 Karschnik et al.
2016/0338871 A1 11/2016 Nunn et al.
2016/0367039 A1 12/2016 Young et al.
2017/0003666 A1 1/2017 Nunn et al.
2017/0049243 A1 2/2017 Nunn et al.
2017/0156508 A1 * 6/2017 Segal ..... A47C 27/001
2017/0164761 A1 * 6/2017 Sramek ..... A47C 27/15
2017/0191516 A1 7/2017 Griffith et al.
2017/0303697 A1 10/2017 Chen et al.
2017/0318980 A1 11/2017 Mahoney et al.
2017/0347814 A1 * 12/2017 Cleyman ..... A47G 9/0238
2017/0354268 A1 12/2017 Brosnan et al.
2018/0078048 A1 3/2018 Pearce
2018/0116415 A1 5/2018 Karschnik et al.
2018/0116418 A1 5/2018 Shakal et al.
2018/0116419 A1 5/2018 Shakal et al.
2018/0116420 A1 5/2018 Shakal
2018/0119686 A1 5/2018 Shakal et al.
2018/0125259 A1 5/2018 Peterson et al.
2018/0125260 A1 5/2018 Peterson et al.
2019/0029597 A1 1/2019 Nunn et al.
2019/0059603 A1 2/2019 Griffith et al.
2019/0082855 A1 3/2019 Brosnan et al.
2019/0104858 A1 4/2019 Erko et al.
2019/0125095 A1 5/2019 Nunn et al.
2019/0125097 A1 5/2019 Nunn et al.
2019/0200777 A1 7/2019 Demirli et al.
2019/0201265 A1 7/2019 Sayadi et al.
2019/0201266 A1 7/2019 Sayadi et al.
2019/0201267 A1 7/2019 Demirli et al.
2019/0201268 A1 7/2019 Sayadi et al.
2019/0201269 A1 7/2019 Sayadi et al.
2019/0201270 A1 7/2019 Sayadi et al.
2019/0201271 A1 7/2019 Grey et al.
2019/0206416 A1 7/2019 Demirli et al.
2019/0209405 A1 7/2019 Sayadi et al.
2019/0279745 A1 9/2019 Sayadi et al.
2019/0328146 A1 10/2019 Palashewski et al.

OTHER PUBLICATIONS

U.S. Appl. No. 15/806,810, filed Nov. 8, 2017, Gaunt.
U.S. Appl. No. 16/731,986, filed Dec. 31, 2019, Holmvik et al.
U.S. Appl. No. 16/730,464, filed Dec. 30, 2019, Sayadi et al.
U.S. Appl. No. 16/714,349, filed Dec. 13, 2019, Sayadi et al.
U.S. Appl. No. 16/714,312, filed Dec. 13, 2019, Demirli et al.
U.S. Appl. No. 16/682,675, filed Nov. 13, 2019, Demirli et al.
U.S. Appl. No. 29/719,090, filed Dec. 31, 2019, Negus et al.

(56) References Cited

OTHER PUBLICATIONS

U.S. Appl. No. 29/690,492, filed May 8, 2019, Stusynski et al.
U.S. Appl. No. 29/676,117, filed Jan. 8, 2019, Stusynski et al.
U.S. Appl. No. 29/583,852, filed Nov. 9, 2016, Keeley.
U.S. Appl. No. 16/122,480, filed Sep. 5, 2018, Shutes et al.
International Search Report and Written Opinion in Application No. PCT/US2019/069097, dated Dec. 17, 2019, 10 pages.

* cited by examiner

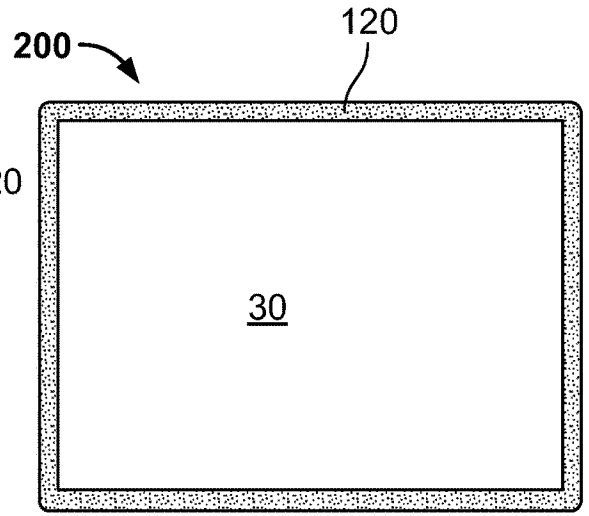
FIG. 3A
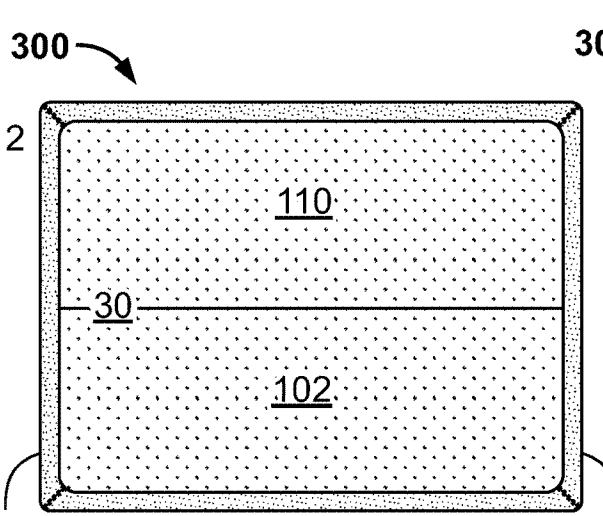
FIG. 3B
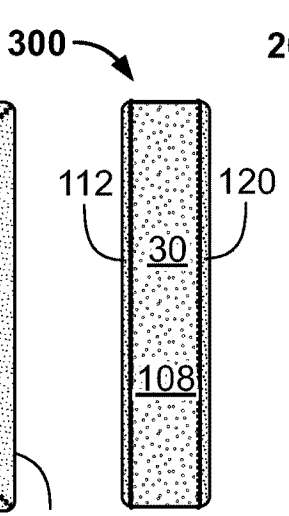
FIG. 3C
FIG. 3D
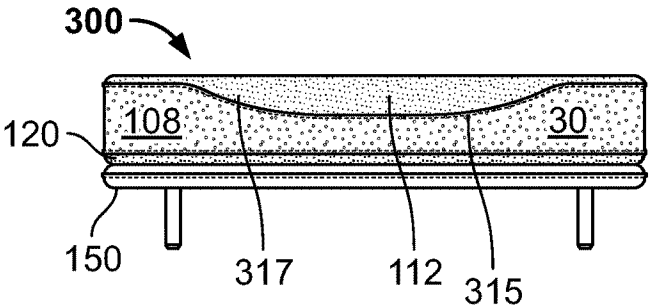
FIG. 3E
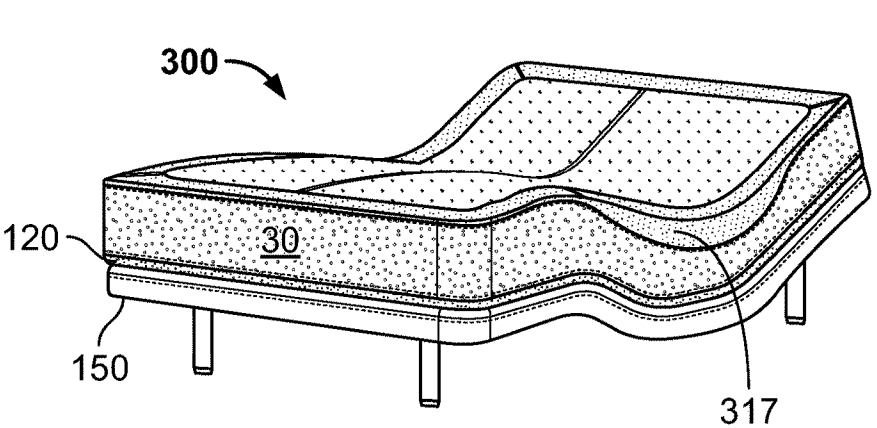
FIG. 3F

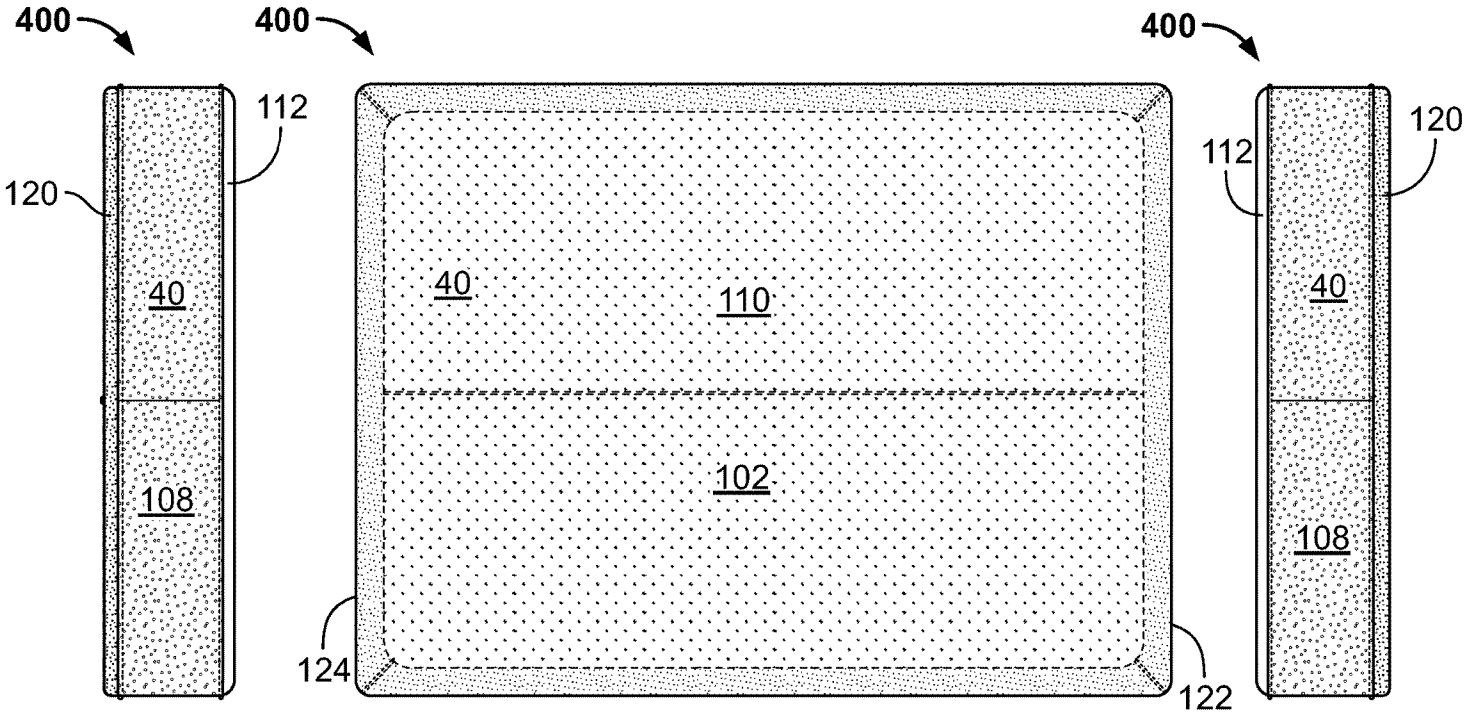
FIG. 4A
FIG. 4B
FIG. 4C
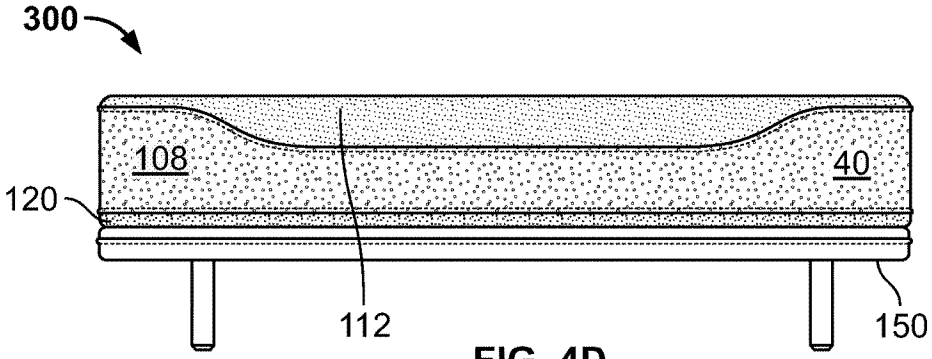
FIG. 4D

MATTRESS COVERING

CLAIM OF PRIORITY

This application claims the benefit under 35 U.S.C. § 119(e) of U.S. Patent Application No. 62/856,485, entitled "MATTRESS COVERING," filed 3 Jun. 2019, which is incorporated herein by reference in its entirety.

The present disclosure relates to a cover for a mattress.

BACKGROUND

In general, a bed is a piece of furniture used as a location to sleep or relax. Many modern beds include a soft mattress on a bed frame. The mattress may include springs, foam material, and/or an air chamber to support the weight of one or more occupants. The mattress may include a mattress cover.

SUMMARY

An example implementation of the subject matter described within this disclosure is a system with the following features. A bed has a mattress with a mattress top, a mattress bottom, and a mattress perimeter. The mattress includes a mattress cover surrounding the mattress. The mattress cover includes a first stretch fabric around the mattress perimeter of the mattress. The first stretch fabric has a first predominant stretch direction that is stretchable in a direction parallel to the mattress top. A multidirectional stretch fabric is positioned on the mattress top.

An example implementation of the subject matter described within this disclosure is a mattress cover with the following features. A first stretch fabric is positioned around a perimeter of a mattress. The first stretch fabric is configured to stretch predominantly in a direction parallel to a mattress top. A four-way stretch fabric is configured to be positioned on the mattress top.

An example implementation of the subject matter described within this disclosure is a method with the following features. A mattress cover with the following features is formed. A first stretch fabric is positioned around a perimeter of a mattress. The first stretch fabric is configured to stretch predominantly in a direction parallel to a mattress top. A four-way stretch fabric is configured to be positioned on the mattress top.

An example implementation of the subject matter described within this disclosure is a method with the following features. Mattress components of a cover are received to form a mattress. The cover includes a first stretch fabric positioned around a perimeter of the mattress. The first stretch fabric is configured to stretch predominantly in a direction parallel to a mattress top. A four-way stretch fabric is positioned on the mattress top. A second stretch fabric is positioned between the first stretch fabric and the four-way stretch fabric. The second stretch fabric is configured to stretch predominantly in a direction between an edge of the four-way stretch fabric and an edge of the first stretch fabric.

An example implementation of the subject matter described within this disclosure is a system with the following features. A bed has a mattress with a mattress top, a mattress bottom, and a mattress perimeter. The mattress includes a mattress cover surrounding the mattress. The mattress cover includes a first stretch fabric around the mattress perimeter of the mattress. A second stretch fabric is positioned on the mattress top. The second stretch fabric has different material properties than the first stretch fabric. A third stretch fabric is positioned on the mattress top and on the mattress perimeter. The third stretch fabric extends from the first stretch fabric to the second stretch fabric. The third stretch fabric has different material properties than the first and second stretch fabrics.

An example implementation of the subject matter described within this disclosure is a system with the following features. A bed has a mattress with a mattress top, a mattress bottom, and a mattress perimeter. The mattress includes a mattress cover surrounding the mattress. The mattress cover includes a first knit stretch fabric forming a mattress border around the mattress perimeter of the mattress. A second knit stretch fabric is positioned on the mattress top. The second knit stretch fabric has different material properties than the first knit stretch fabric and is configured to stretch to an amount suitable to allow a user to sink comfortably into the mattress when resting on the mattress top. A third knit stretch fabric is positioned on the mattress top and on the mattress perimeter to form a connection between the first knit stretch fabric and the second knit stretch fabric. The third knit stretch fabric has different material properties than the first and second knit stretch fabrics.

An example implementation of the subject matter described within this disclosure is a system with the following features. A bed has a mattress with a mattress top, a mattress bottom, and a mattress perimeter. The mattress includes a mattress cover surrounding the mattress. The mattress cover includes a first knit stretch fabric around the mattress perimeter of the mattress and a second knit stretch fabric positioned on the mattress top. The second knit stretch fabric has different material properties than the first knit stretch fabric. A first woven fabric is positioned around the mattress perimeter of the mattress proximate the mattress bottom. The first woven fabric is connected to the first knit stretch fabric.

Implementations previously described can include any, all, or none of the following features.

The mattress cover can further include a second stretch fabric positioned between the first stretch fabric and the multidirectional stretch fabric. The second stretch fabric has a second predomination stretch direction that is stretchable in a direction between an edge of the multidirectional stretch fabric and an edge of the first stretch fabric.

The second stretch fabric can be at least partially on the mattress top and at least partially on the mattress perimeter.

The mattress can include a left side and a right side. The first stretch fabric includes a first portion along the left side that is narrower than a height of the mattress and a second portion along the right side that is narrower than the height of the mattress.

The first portion and the second portion can be the same height.

The first portion and the second portion can include a bottom portion that is in-line with a bottom side of the mattress. The second stretch fabric extends between the multidirectional stretch fabric to the edge of the first stretch fabric. The second stretch fabric is both on the mattress top and at least partially along the left side and the right side.

A portion of the first stretch fabric at a head of the mattress and at a foot of the mattress can extend between the mattress top and a mattress bottom.

The first portion and the second portion each include a head section nearer a head of the bed and a foot section nearer the foot of the bed. Each of the head sections and the foot sections have a height substantially similar to a height of the mattress.

The first stretch fabric and the second stretch fabric can each stretch multi directionally.

The first stretch fabric and the second stretch fabric can each stretch mono-directionally.

The first stretch fabric and the multidirectional stretch fabric can each include knit materials having different properties from one another.

A second stretch fabric can be positioned between the first stretch fabric and the four-way stretch fabric. The second stretch fabric is configured to stretch predominantly in a direction between an edge of the four-way stretch fabric and an edge of the first stretch fabric.

The second stretch fabric can be configured to be positioned at least partially on the mattress top.

The first stretch fabric can include a first portion configured to be positioned along a left side of the mattress. The first portion is narrower than a height of the mattress. The first stretch fabric includes a second portion configured to be positioned along a right side of the mattress. The second portion is less than the height of the mattress.

The first portion and the second portion can be the same height.

The first portion and the second portion can include a bottom portion configured to be in-line with a bottom side of the mattress. The second stretch fabric extends between the four-way stretch fabric to the edge of the first stretch fabric. The second stretch fabric is configured to be both on the mattress top and at least partially along the left mattress side and the right mattress side.

A third portion of the first stretch fabric can be configured to be at a head of the mattress and a fourth portion can be configured to be at a foot of the mattress. The third portion and the fourth portion are configured to extend between the mattress top and a mattress bottom.

The first portion and the second portion can each include a head section configured to be nearer a head of the mattress and a foot section configured to be nearer the foot of the mattress. Each of the head sections and the foot sections having a height substantially similar to a height of the mattress.

The mattress cover can further include a second stretch fabric positioned between the first stretch fabric and the four-way stretch fabric. The second stretch fabric is configured to stretch predominantly in a direction between an edge of the four-way stretch fabric and an edge of the first stretch fabric.

A foam tub and a mattress core can be received by the mattress cover.

The cover can be formed.

The third stretch fabric can be configured to stretch more than the first and second stretch fabrics.

The first stretch fabric can be configured to stretch less than the second and third stretch fabrics.

The first stretch fabric can have a thicker weight knit than the second and third stretch fabrics.

The first, second, and third stretch fabrics can each be multidirectional stretch fabrics with different stretch properties.

The first woven fabric can be laminated.

The first woven fabric can be a non-stretch woven fabric.

The mattress cover can further include a third knit stretch fabric configured to form a connection between the first knit stretch fabric and the second knit stretch fabric. The third knit stretch fabric has different material properties than the first and second knit stretch fabrics.

The subject matter described herein can allow for better mattress performance due to a better performing mattress cover. Alternatively or in addition, the subject matter described herein can allow for a better fitting and/or functioning mattress cover, which allows for improved aesthetics because the cover stays in place and wrinkles less. The mattress cover can include different panels of different stretch materials with different material properties suitable for particular functions combined in a way to improve mattress functionality.

Other features, aspects, and potential advantages will be apparent from the accompanying description and figures.

DESCRIPTION OF DRAWINGS

FIGS. 3A-3F are multi-view and perspective schematic drawings of a mattress having an example mattress cover.

FIGS. 4A-4D are multi-view and perspective schematic drawings of a mattress having an example mattress cover.

Like reference symbols in the various drawings indicate like elements.

DETAILED DESCRIPTION

Traditional mattress ticking that is used as fabric that covers a mattress often has very little stretch. Consequently, it pulls on interior mattress components (such as foam) when an occupant lays on the mattress. A border of the cover can be a woven material with little or no stretch properties and can retain unsightly wrinkles after it is compressed by the occupant. These two materials (ticking and border) are often sewn together to form a cover for the mattress.

The subject matter of this disclosure relates to a mattress cover that reduces permanent deformation and wear of foam material of a mattress. While described in the context of foam material (such as a foam tub), the subject matter described herein can easily be applied to mattresses having other materials (such as spring tubs and other spring material) as well. The foam tub (or spring tub) can surround a mattress core. In some embodiments, the foam tub (or spring tub) can surround one or more inflatable air chambers used as the mattress core. In some embodiments, the foam tub (or spring tub) can surround one or more spring and/or foam components used as the mattress core. In other embodiments, the foam tub (or spring tub) can be replaced with one or more other mattress components (i.e. foam, springs, air chambers, and/or other components).

A mattress cover can have multiple panels made of materials that are configured to function for a certain purpose. For example, a monofilament spacer material can be used for the sleep surface directly underneath where the occupant would typically lay. This material can have multidirectional (i.e. four-way) stretch properties to help the foam and air chamber of the bed to conform to and supports the unique contours of the occupant's body. Such a spacer also could potentially have a positive impact on the occupant's temperature by allowing for airflow. A multidirectional or predominantly mono-directional (i.e. two-way) stretch fabric around the perimeter of the sleep surface helps the cover return to shape after the occupant gets out of the bed. The perimeter material attaches to a border material that also has multidirectional or predominantly mono-directional (two-way) stretch properties around the bed to help accommodate foam tolerance and recover from flexing and compression. A woven material can be positioned below and attached to the border material on the sides of the mattress. The woven material can be non-stretch woven material that has limited or no capacity for stretching and recovery and can be suitable for structurally retaining a bottom of the mattress. In some embodiments, a mattress cover can include panels of fabric including one, more than one, or all of these materials. In some embodiments, one or more panels of fabric can be different as suitable for the application.

Figure 1:
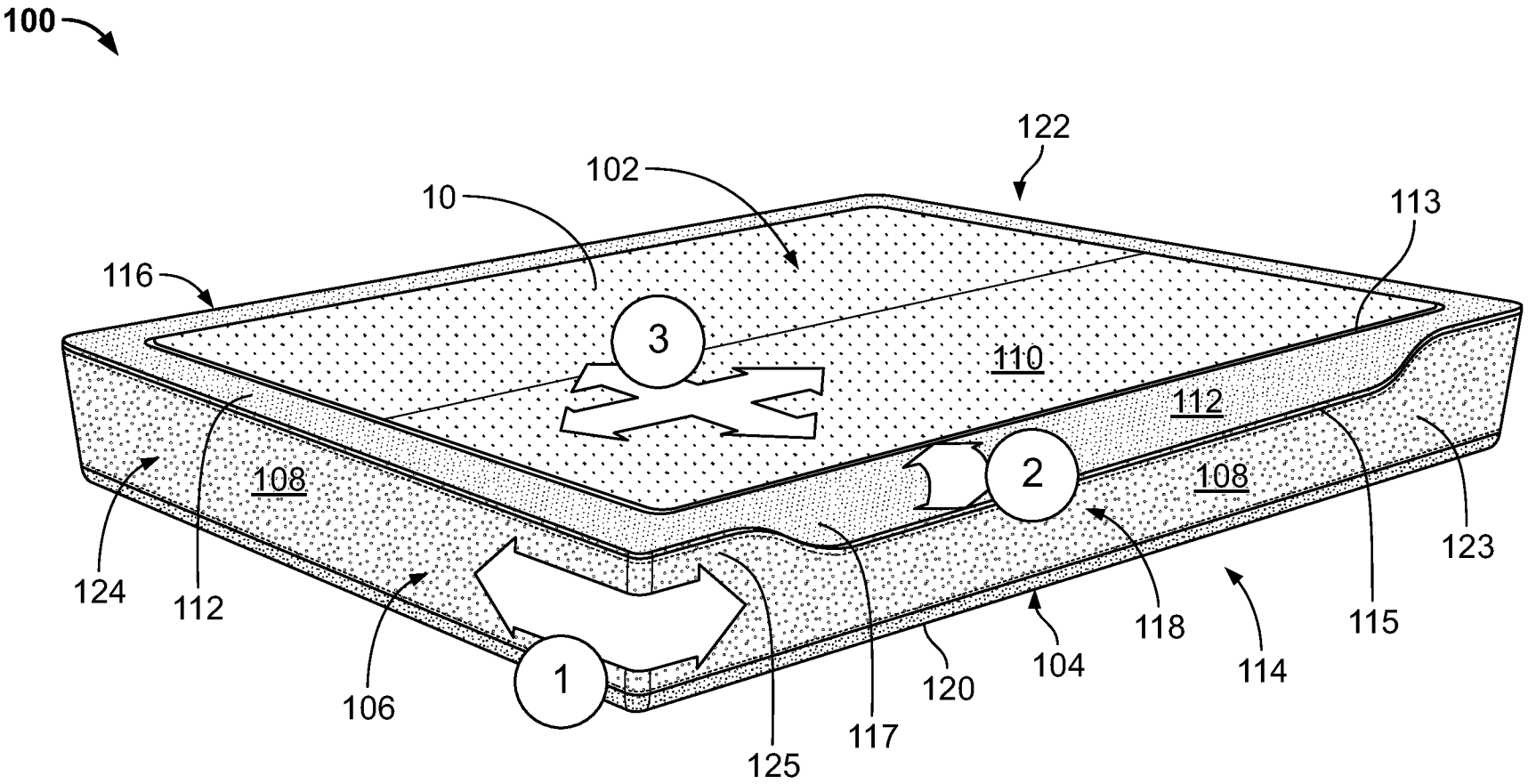
FIG. 1 is a perspective view of a mattress having an example mattress cover.

FIG. 1 is a perspective view of a mattress 10 having an example mattress cover 100 installed over the mattress 10. The mattress 10 includes a mattress top 102, a mattress bottom 104, and a mattress perimeter 106. The mattress cover 100 surrounds the mattress 10 and includes a stretch fabric 108 around the mattress perimeter 106. The stretch fabric 108 is stretchable in a direction parallel to the mattress top 102. The stretch fabric 108 helps accommodate foam tolerance and recovery from flexing and compression. Such stretching and compression can be caused by general use of the mattress, using an adjustable base with the mattress, shipping the mattress, or any other scenarios that can cause foam deformation to the mattress edges. A stretch fabric 110 is positioned on the mattress top 102. The stretch fabric 110, configured to be positioned on the mattress top 102, allows for sufficient stretch for the mattress 10 to fully support an occupant without interference from the mattress cover 100. In some implementations, the stretch fabric 110 can include a spacer fabric with a monofilament spacer material. Spacer fabrics contain a combination of textile sheets and distance fibers, with a porous structure that can offer high absorption capacities for textile materials. The distance fibers can be monofilament polyester fibers with a sufficient stiffness to maintain spacing within the fabric. As such, spacer fabrics can resist high pressure and can transport fluid and heat, for example, sweat and body heat. In such an implementation, the spacer material allows for at least a small amount of airflow to help keep the occupant cool and dry. In some implementations, the mattress cover 100 also includes a stretch fabric 112 positioned between the stretch fabric 108 and the stretch fabric 110. The stretch fabric 112 is stretchable in a direction between a stretch fabric edge 113 and a stretch fabric edge 115. As illustrated, the stretch fabric 112 is at least partially on the mattress top 102 and partially along the mattress perimeter 106. The stretch fabric 112 helps the mattress cover 100 return to shape after an occupant leaves the mattress 10.

Different panels of fabric can be attached to each other at one or more seams, such as via sewing/stitching. For example, the stretch fabric 108, the stretch fabric 110, the stretch fabric 112 can be sewn together forming multiple seams. Seams can also be included by stitching together panels of the same kind of fabric. For example, the stretch fabric 110 on the mattress top 102 can be formed of two panels of the stretch fabric 110 sewn together with a seam down the middle, such as illustrated in FIG. 1. Alternatively, the stretch fabric 110 can be formed via a single panel of material, with no seam down the middle of the mattress 100. In further alternative embodiments, the number and shape of fabric panels can be further varied from the illustrated examples.

The mattress cover 100 includes a left side 116 and a right side 114. In some implementations, the stretch fabric 112 includes a "waterfall" or wing 117 around an upper corner of the mattress 10, stretching partially on the mattress top 102 and partially along the mattress perimeter 106. The stretch fabric 108 has a first portion (not shown) along the left side 116 that is narrower than a height of the mattress and a second portion 118 along the right side 114 that is narrower than the height of the mattress. The first portion and the second portion 118 can be the same height (within standard manufacturing tolerances). The stretch fabric 112 extends between the stretch fabric 110 to the stretch fabric edge 115. The stretch fabric 112 is both on the mattress top 102 and at least partially along the left side 116 and the right side 114. A portion of the stretch fabric 108 at a head 122 of the mattress and at a foot 124 of the mattress 10 extends between the mattress top 102 and a mattress bottom 104. The first portion and the second portion 118 each include a head section 123 nearer a head 122 of the bed and a foot section 125 nearer the foot 124 of the bed. Each of the head sections 123 and the foot sections 125 have a height substantially similar (within standard manufacturing tolerances) to a height of the mattress 10.

A bottom fabric 120 extends from a bottom edge of the stretch fabric 108 to a bottom of the mattress 10. The bottom fabric 120 can be a substantially non-stretch woven material configured to substantially resist stretching or to prevent stretching. By resisting stretching, the bottom fabric 120 can help provide rigidity to a bottom portion of the mattress 10, which can be beneficial in embodiments of the mattress 10 having an upside-down foam or spring tub and in other embodiments of the mattress 10 that benefit from substantially non-stretch woven material. In some embodiments, the bottom fabric 120 can include the substantially non-stretch woven material in combination with a laminate material that can provide some rigidity as well as fire resistance properties.

In embodiments that do not benefit from a substantially non-stretch woven material being used, the bottom fabric 120 can include a different material. For example, in some embodiments the bottom fabric 120 can include a knit material or a stretch knit material. A stretch knit material can be used in embodiments that benefit from having the bottom fabric 120 being stretchable by a small amount or even a large amount. In some embodiments, the bottom fabric 120 can be a knit material with little or no ability to stretch.

Some or all of the stretch fabric 108, the stretch fabric 110, and the stretch fabric 112 can be different fabrics having different properties. For example, the stretch fabric 108, the stretch fabric 110, and the stretch fabric 112 can each include knit materials that are configured to stretch and resiliently rebound/recover to shape, but can have different properties such as knit thickness, capacity for stretching, etc. In some embodiments, the stretch fabric 108 can include a knit material with a relatively thick weight knit and a relatively limited capacity for stretching. The stretch fabric 108 can allow for some stretching on the sides of the mattress 10 while also providing a desirable level of stiffness and support for the mattress 10. The stretch fabric 110 can include a knit material with a relatively thin weight knit and a relatively large capacity for stretching. The stretch fabric 110 can be configured to stretch enough to allow a user lying on the mattress 10 to sink into the foam or other material under the stretch fabric 110 without the stretch fabric 110 providing an undesirable amount of tension. The stretch fabric 110 can include a spacer material, or can be made without a spacer material. The stretch fabric 112 can include a knit material with a relatively thin weight knit and a relatively large capacity for stretching. The stretch fabric 112 can be configured to resiliently connect the stretch fabric 110 on top of the mattress 10 to the stretch fabric 108 on the sides of the mattress 10. The stretch fabric 112 can be configured to stretch more than both of the stretch fabrics 110 and 108 so as to substantially keep the stretch fabrics 110 and 108 under tension without pulling with an undesirably high amount of tension. In other embodiments, the knit thickness, capacity for stretching, and other material properties of the stretch fabric 108, the stretch fabric 110, and the stretch fabric 112 can be varied as suitable for the application.

In some embodiments, the stretch fabric 108, the stretch fabric 110, and the stretch fabric 112 can have multidirectional (e.g. four-way) stretch properties. In some of such embodiments, one or more of the stretch fabric 108, the stretch fabric 110, and the stretch fabric 112 can have a dominant stretch direction. For example, the stretch fabric 108 can stretch predominantly in a direction around a perimeter of the mattress 10, with less stretching in a vertical direction. The stretch fabric 112 can stretch predominantly in a direction extending from the stretch fabric 108 to the stretch fabric 110, with less stretching in a perpendicular direction. The stretch fabric 110 can stretch either equally or substantially equally in each direction.

In some embodiments, one or more of the stretch fabric 108, the stretch fabric 110, and the stretch fabric 112 can have mono-directional (e.g. two-way) stretch properties. For example, in some of such embodiments, the stretch fabric 108 can stretch only in a direction around a perimeter of the mattress 10, with no stretching in a vertical direction. The stretch fabric 112 can stretch only in a direction extending from the stretch fabric 108 to the stretch fabric 110, with no stretching in a perpendicular direction. The stretch fabric 110 can have multi directional stretch properties so as to stretch either equally or substantially equally in each direction.

The following paragraphs describe specific implementations of mattress covers that can be used with aspects of this disclosure. The following implementations are only examples. The features described herein can be applied to a number of implementations. That is, specific features can be mixed between different implementations. The following implementations should not be considered a complete list of all possible implementations of the mattress covers described by this disclosure, but rather, are examples of some possible embodiments.

Figures 2A, 2B, 2C, 2D, 2E, 2F:
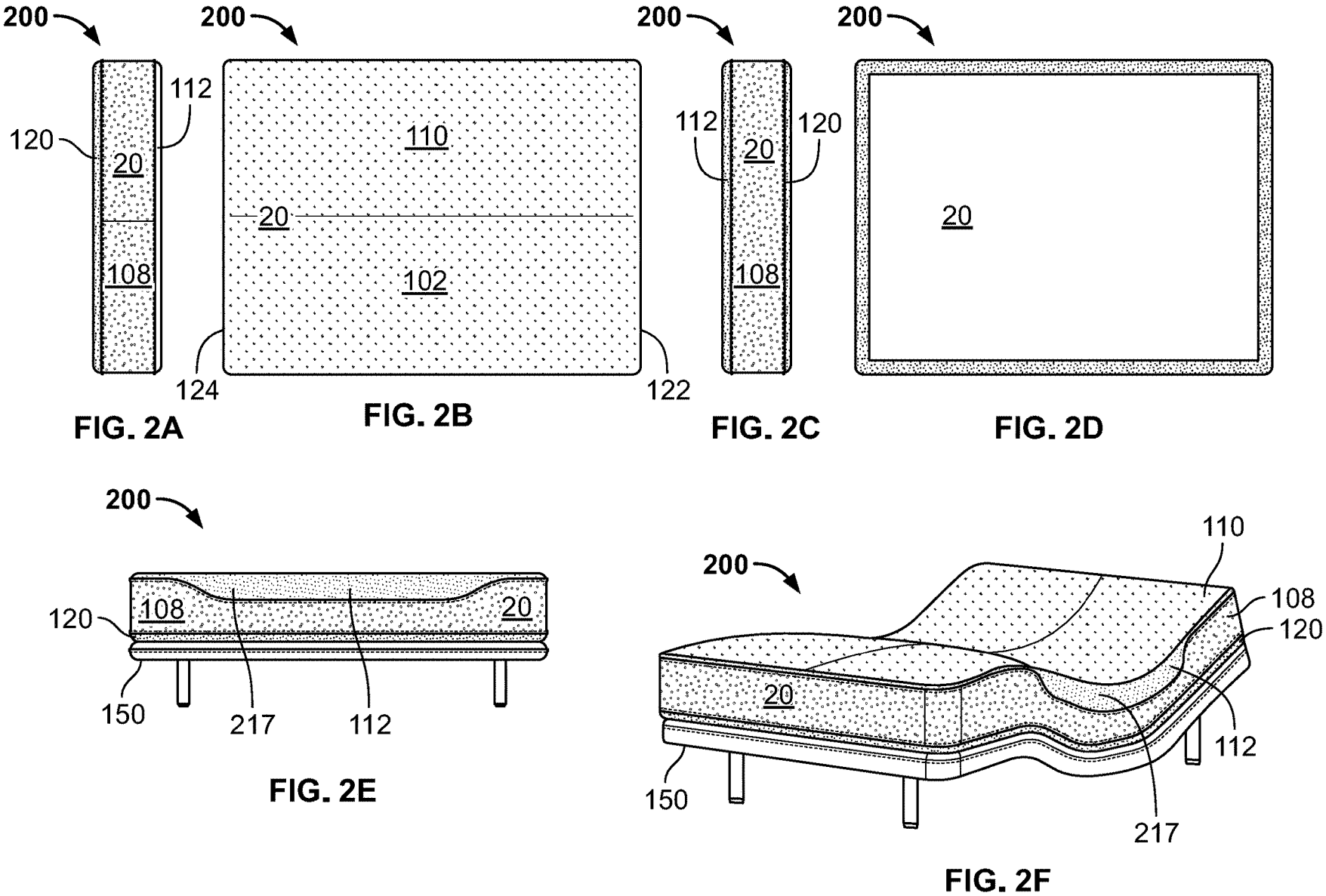
FIGS. 2A-2F are multi-view and perspective schematic drawings of a mattress having an example mattress cover.

FIGS. 2A-2F are multi-view and perspective schematic drawings of a mattress 20 having an example mattress cover 200 installed over the mattress 20. FIG. 2A is a side view of a foot 124 of the mattress cover 200. FIG. 2B is a top view of the mattress cover 200. FIG. 2C is a side view of a head 122 of the mattress cover 200. FIG. 2D is a bottom view of the mattress cover 200. FIG. 2E is a side view of the right side of the mattress cover 200 while installed around a mattress resting upon a bed foundation 150. FIG. 2F is a perspective view of the mattress cover 200 installed around the mattress 20 resting upon an adjustable bed foundation 150. The mattress 20 and mattress cover 200 are substantially similar to the mattress 10 and mattress cover 100 with the exception of differences described herein. In this implementation, the stretch fabric 110 extends across the entire mattress top 102, while the stretch fabric 112 extends only along the sides of the mattress 20, stretching between the edge of the stretch fabric 110 to the edge of the stretch fabric 108. Referring to FIG. 2F, the wings 217 are arranged such that the mattress 20 contours to an adjustable foundation 150 better than if the wings 217 were not present. The wings 217 also reduce permanent wear and deformation from the use of an adjustable foundation 150.

FIGS. 3A-3F are multi-view and perspective schematic drawings of a mattress 30 having an example mattress cover 300 installed over the mattress 30. FIG. 3A is a side view of a foot 124 of the mattress cover 300. FIG. 3B is a top view of the mattress cover 300. FIG. 3C is a side view of a head 122 of the mattress cover 300. FIG. 3D is a bottom view of the mattress cover 300. FIG. 3E is a side view of the right side of the mattress cover 300 while installed around the mattress 30 resting upon a bed foundation 150. FIG. 3F is a perspective view of the mattress cover 300 installed around the mattress 30 resting upon an adjustable bed foundation 150. The mattress 30 and mattress cover 300 are substantially similar to the mattress 10 and mattress cover 100 with the exception of differences described herein.

The mattress 30 has the stretch fabric 112 positioned on both the top and the sides of the mattress 30, extending from the stretch fabric 110 to the stretch fabric 108. Accordingly, the stretch fabric 112 forms somewhat of a waterfall from the top of the mattress 40 over the sides of the mattress 40.

In this implementation, the wing portion 317 is a different shape that includes a gradual curve along an edge 315 of the stretch fabric 108. Referring to FIG. 3F, the wings 317 are arranged such that the mattress 30 contours to an adjustable foundation 150 better than if the wings 317 were not present. The wings 317 also reduce permanent wear and deformation from the use of an adjustable foundation 150.

FIGS. 4A-4F are multi-view and perspective schematic drawings of a mattress 40 having an example mattress cover 400 installed over the mattress 40. FIG. 4A is a side view of a foot 124 of the mattress cover 400. FIG. 4B is a top view of the mattress cover 400. FIG. 4C is a side view of a head 122 of the mattress cover 400. FIG. 4D is a side view of the right side of the mattress cover 400 while installed around the mattress 40 resting upon a bed foundation 150. The mattress 40 and mattress cover 400 are substantially similar to the mattress 10 and mattress cover 100 with the exception of differences described herein. Like the example shown in FIGS. 3A-3F, the mattress 40 has the stretch fabric 112 positioned on both the top and the sides of the mattress 40, extending from the stretch fabric 110 to the stretch fabric 108. Accordingly, the stretch fabric 112 forms somewhat of a waterfall from the top of the mattress 40 over the sides of the mattress 40.

Figure 5A:
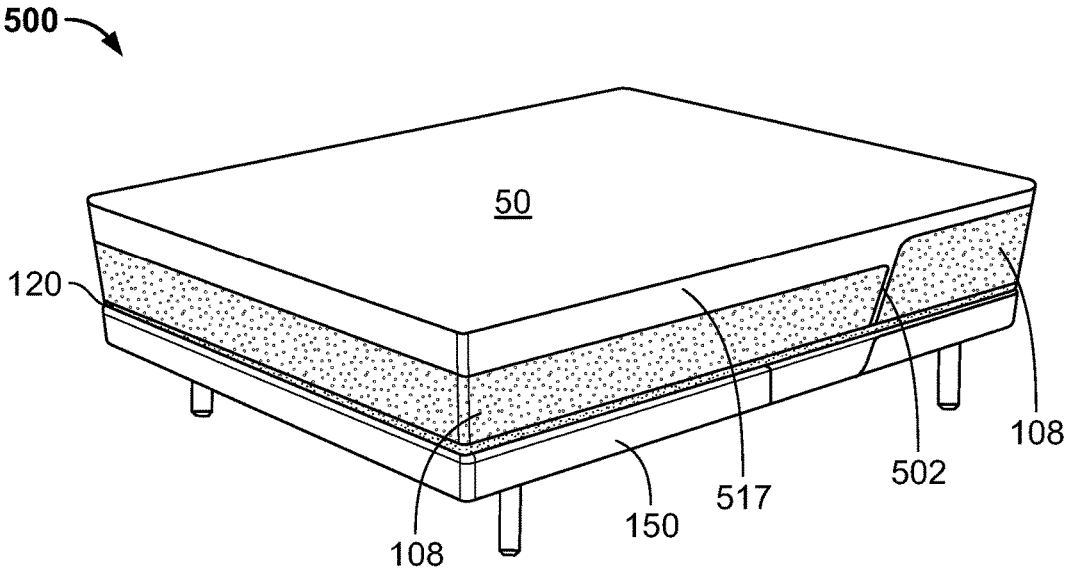
FIGS. 5A-5D are perspective schematic drawings of a mattress having an example mattress cover and various corner configurations for the example mattress.
Figure 5B:
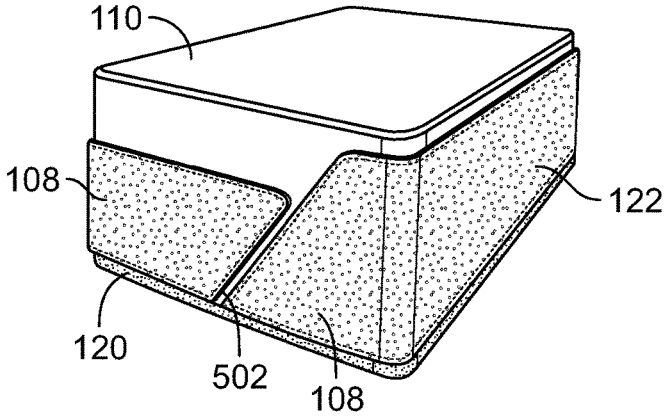
Figure 5D:
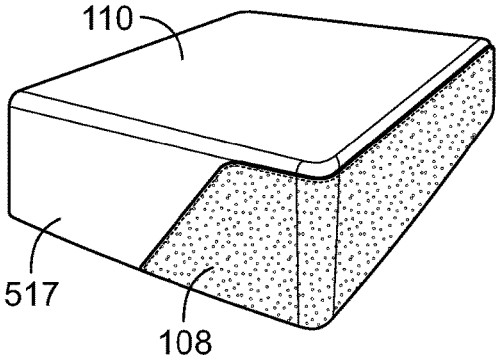
Figure 5C:
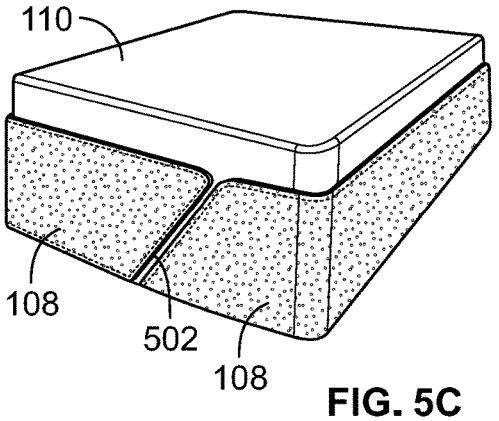

FIGS. 5A-5D are perspective schematic drawings of a mattress 50 having an example mattress cover 500 installed over the mattress 50 and various corner configurations for the example mattress 50. FIG. 5A is a perspective view of a mattress cover 500. The mattress 50 and mattress cover 500 are substantially similar to the mattress 10 and mattress cover 100 with the exception of differences described herein. The mattress cover 500 includes a wing section 517 that extends around the left side 116 of the mattress 50, the foot 124 of the mattress 50, and the right side 114 of the mattress 50. The stretch fabric 108 includes a narrow split 502 along each side near (i.e. within two to three feet of) the head 122 of the mattress 50. FIG. 5B is an example corner that can be used with mattress cover 500. In this implementation, the narrow split 502 is nearer the head 122 of the mattress. FIG. 5C is an example corner that can be used with mattress cover 500. In this implementation, the stretch fabric 108 is a uniform height around the mattress perimeter 106 of the mattress, eliminating the wings 517. FIG. 5D is an example corner that can be used with mattress cover 500. In this implementation, the stretch fabric 108 is limited to a portion along the side near the head of the mattress 50 and along the head of the mattress 50. Such an implementation increases the length and height of the wings 517. In some implementations, the stretch fabric 108 can be used on the foot 124 as well. In some implementations, the stretch fabric 112 can be limited to the mattress perimeter 106 or eliminated entirely.

Figure 6A:
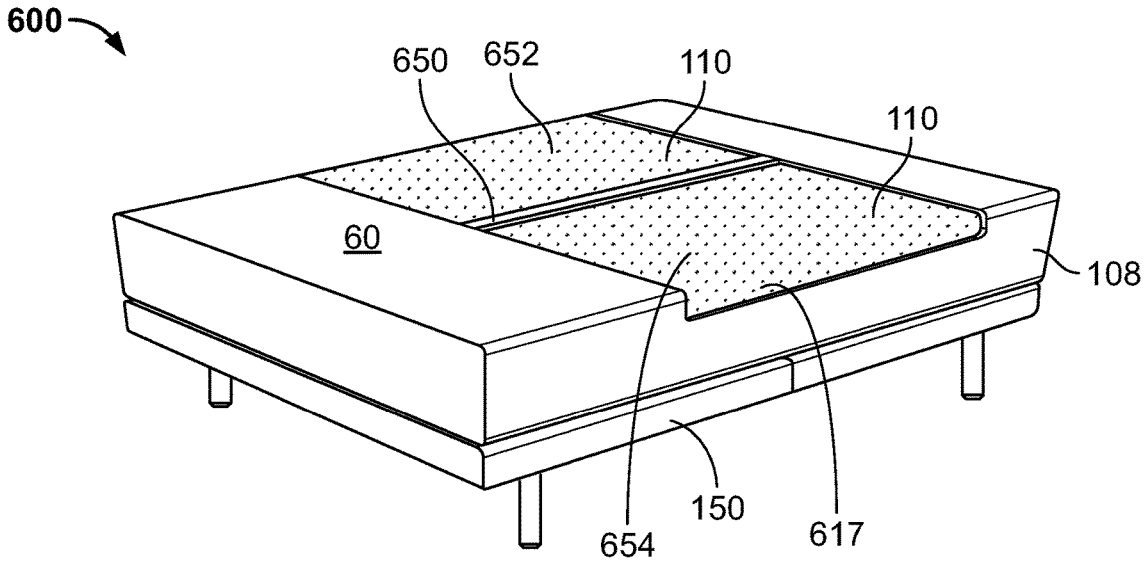
FIGS. 6A-6D are perspective schematic drawings of a mattress having an example mattress cover and various corner configurations for the example mattress.

FIGS. 6A-6D are perspective schematic drawings of a mattress 60 having an example mattress cover 600 installed over the mattress 60 and various corner configurations for the example mattress 60. FIG. 6A is a perspective view of the mattress cover 600. The mattress 60 and mattress cover 600 are substantially similar to the mattress 10 and mattress cover 100 with the exception of differences described herein. The mattress cover 600 includes a wing section 617 that is shorter in length than that illustrated in FIG. 1. In this implementation, the stretch fabric 110 is positioned primarily on top of the mattress 60 and also extends partially over the side of the mattress 60. The stretch fabric 108 can be positioned primarily around the perimeter sides of the mattress 60 and also extend on to parts of the top of the mattress 60. The mattress cover 600 includes a divider section 650 that extends between the head 122 and the foot 124 of the mattress 60. The divider section 650 can be formed of the stretch fabric 108 and can separate the stretch fabric 110 into a left section 652 and a right section 654.

In some embodiments of the mattress 60, the stretch fabric 110 and the stretch fabric 108 can each stretch multidirectionally and have different material properties suitable for the application. In other embodiments of the mattress 60, the stretch fabric 110 can stretch multidirectionally and the stretch fabric 108 can be replaced with a woven material with little or no capacity for resiliently stretching.

Figure 6B:
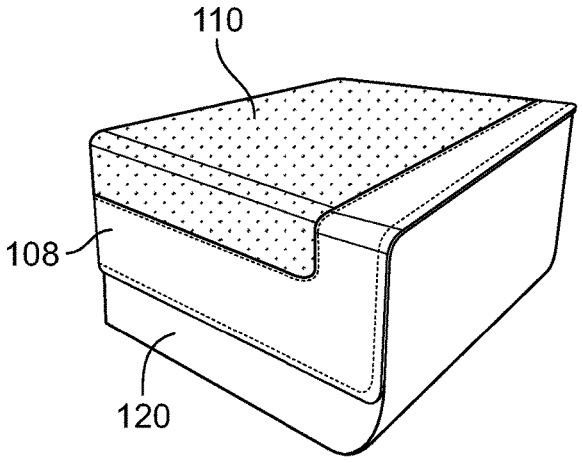
Figure 6C:
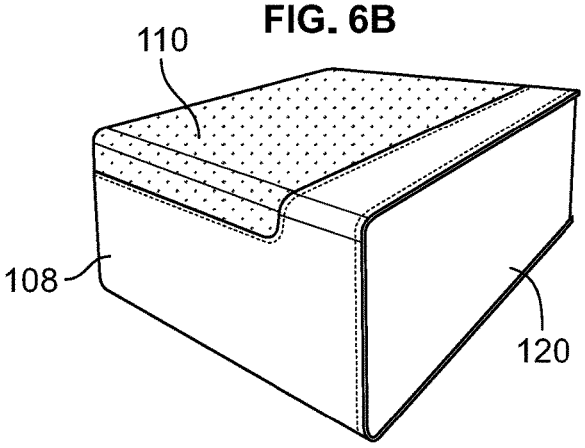
Figure 6D:
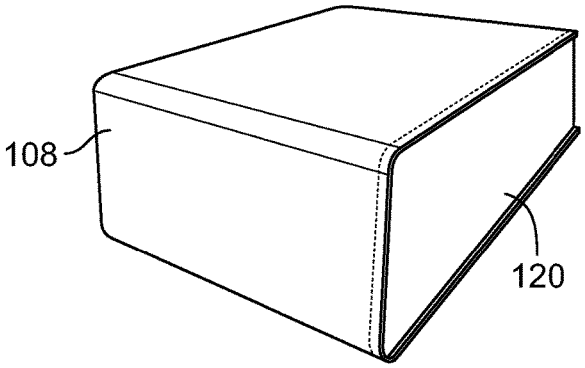

FIG. 6B-6D are example corners that can be used with mattress cover 600.

Figure 7A:
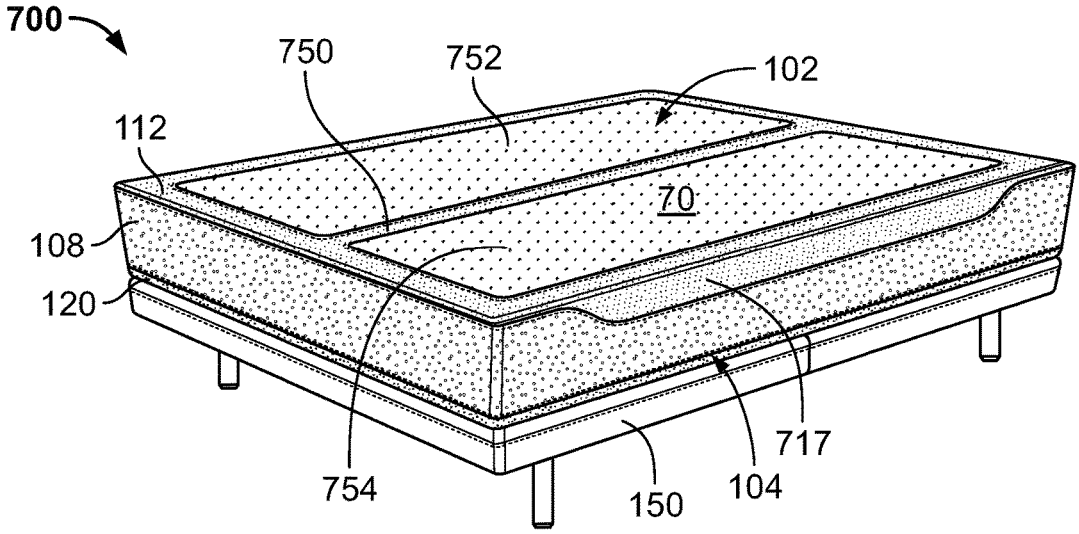
FIGS. 7A-7D are perspective schematic drawings of a mattress having an example mattress cover and various corner configurations for the example mattress.
Figure 7B:
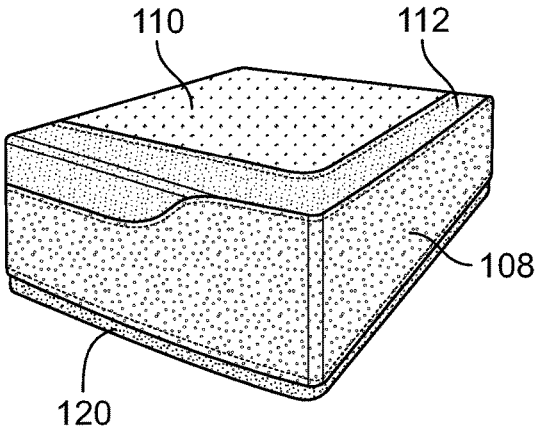
Figure 7D:
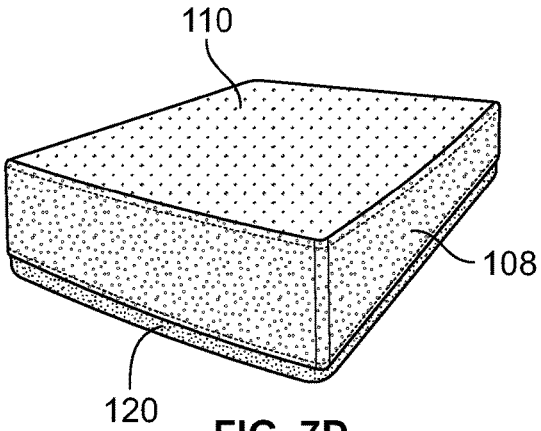
Figure 7C:
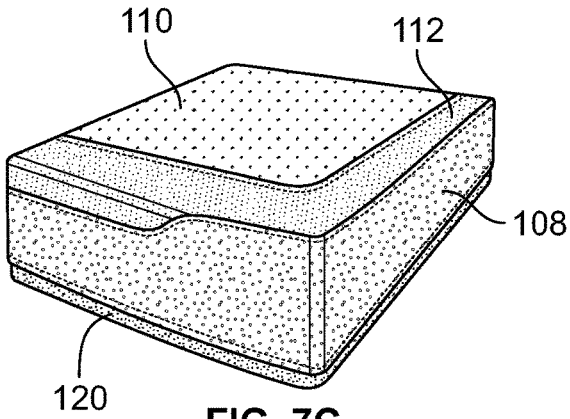

FIGS. 7A-7D are perspective schematic drawings of a mattress 60 having an example mattress cover 700 installed over the mattress 70 and various corner configurations for the example mattress 70. FIG. 7A is a perspective view of the mattress cover 700. The mattress 70 and the mattress cover 700 are substantially similar to the mattress 10 and mattress cover 100 with the exception of differences described herein. The mattress cover 700 includes a divider section 750 that extends between the head 122 and the foot 124 of the mattress 70. The divider section 750 separates the stretch fabric 110 into a left section 752 and a right section 754. FIG. 7B is an example corner that can be used with mattress cover 700. FIG. 7C is an example corner that can be used with mattress cover 700. The mattress 70 shown in FIG. 7B is thicker than the mattress 70 shown in FIG. 7C. The stretch fabric 108 extends between a mattress bottom 104 and mattress top 102 of the mattress 70 near the head 122 and foot 124 of the mattress 70 in both implementations. FIG. 7D is an example corner that can be used with the mattress cover 700. In this implementation, the stretch fabric 110 is extended while the stretch fabric 112 is reduced or eliminated. Such an implementation decreases the length wings 717 or eliminates them entirely. In some implementations, the stretch fabric 108 can be used solely on the head 122 or solely on the foot 124.

Figure 8A:
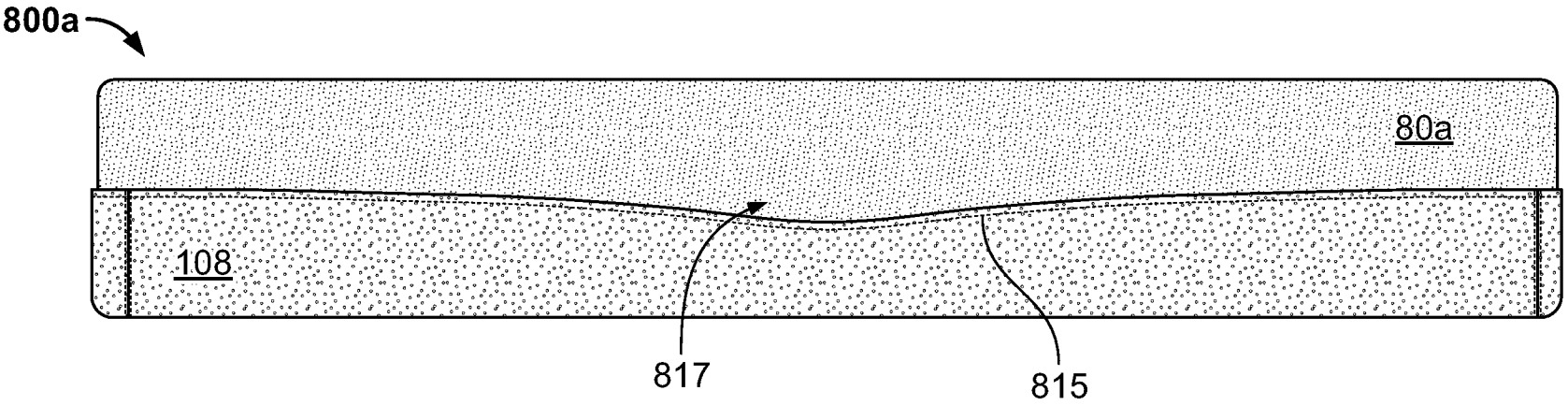
FIGS. 8A-8B are side-view schematic drawings of a mattress having an example mattress cover.
Figure 8B:
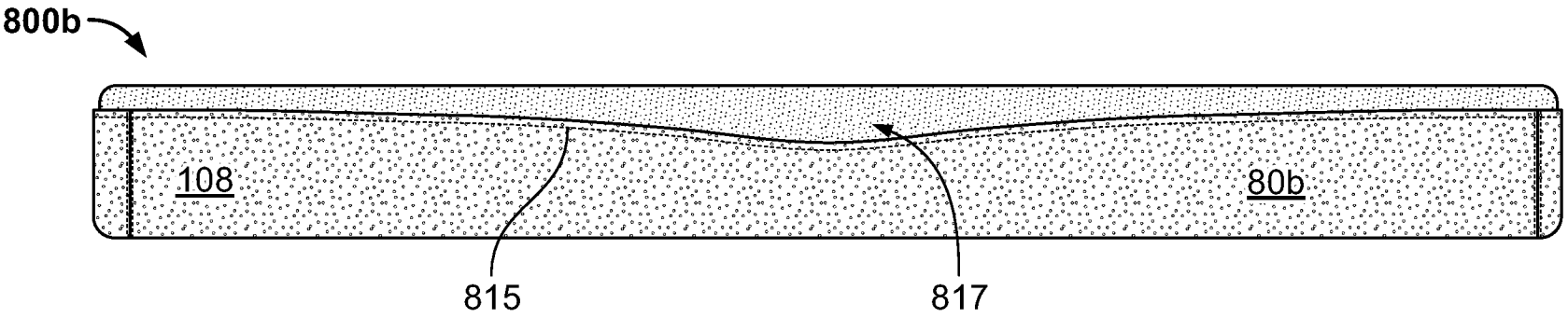

FIGS. 8A-8B are side-view schematic drawings of mattresses 80*a* and 80*b* having example mattress covers 800*a* and 800*b* installed over the mattresses 80*a* and 80*b*. The mattresses, 80*a* and 80*b*, and mattress covers, 800*a* and 800*b*, are substantially similar to the mattress 10 and mattress cover 100 with the exception of differences described herein. FIG. 8A shows a thicker mattress 80*a* than the mattress 80*b* of FIG. 8B. The stretch fabric 108 remains at the same height for both mattresses 80*a* and 80*b*, even though the mattress 80*a* is thicker. The illustrated implementations can include the stretch fabric 112, or they can include only the stretch fabric 110. The illustrated implementations have demure wings 817 defined by a mild curve along the edge 815 of the stretch fabric 108. These wings 817 are smaller in height and length in comparison to the mattress cover 100 illustrated in FIG. 1.

Figure 9A:
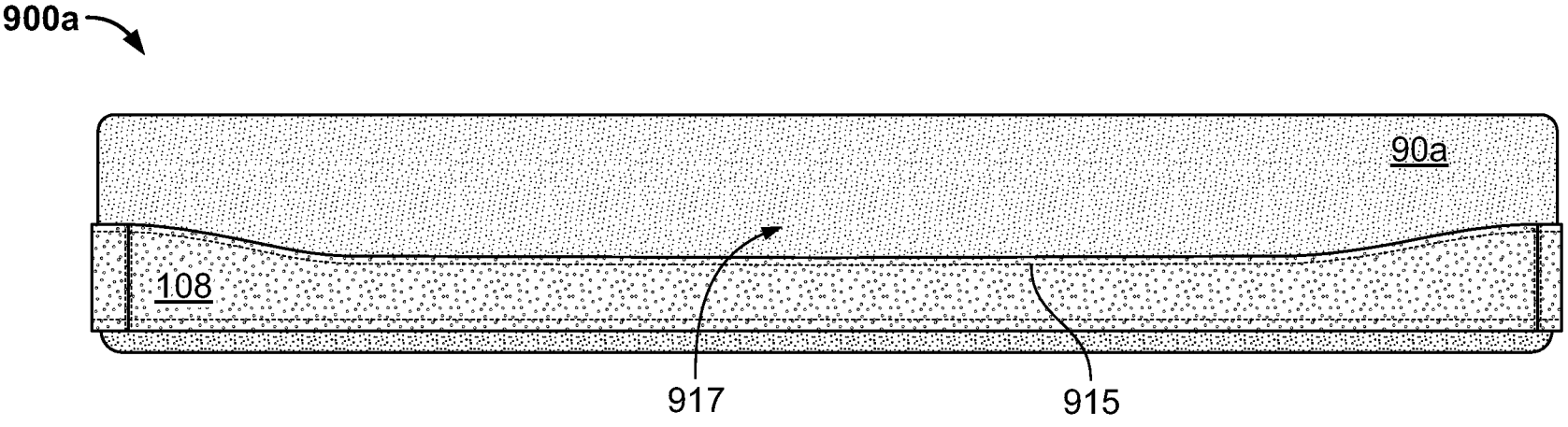
FIGS. 9A-9B are side-view schematic drawings of a mattress having an example mattress cover.
Figure 9B:
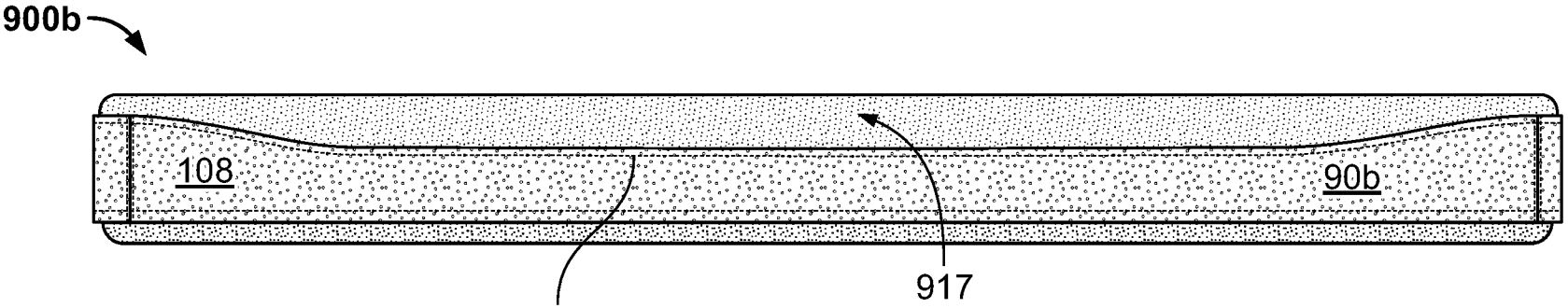

FIGS. 9A-9B are side-view schematic drawings of mattresses 90*a* and 90*b* having example mattress covers 900*a* and 900*b* installed over the mattresses 90*a* and 90*b*. The mattresses, 90*a* and 90*b*, and mattress covers, 900*a* and 900*b*, are substantially similar to the mattresses, 80*a* and 80*b*, and mattress covers, 800*a* and 800*b*, respectively, with the exception of differences described herein. FIG. 9A shows a thicker mattress 90*a* than the mattress 90*b* shown in FIG. 9B. The stretch fabric 108 remains at the same height in both mattresses 90*a* and 90*b*, even though the mattress 90*a* is thicker. The illustrated implementations can include the stretch fabric 112, or they can include only the stretch fabric 110. The illustrated implementations have wings 917 defined by a mild curve along the edge 915 of the fabric. These wings 917 are similar in height and length to the mattress cover 100 illustrated in FIG. 1.

Figure 10A:
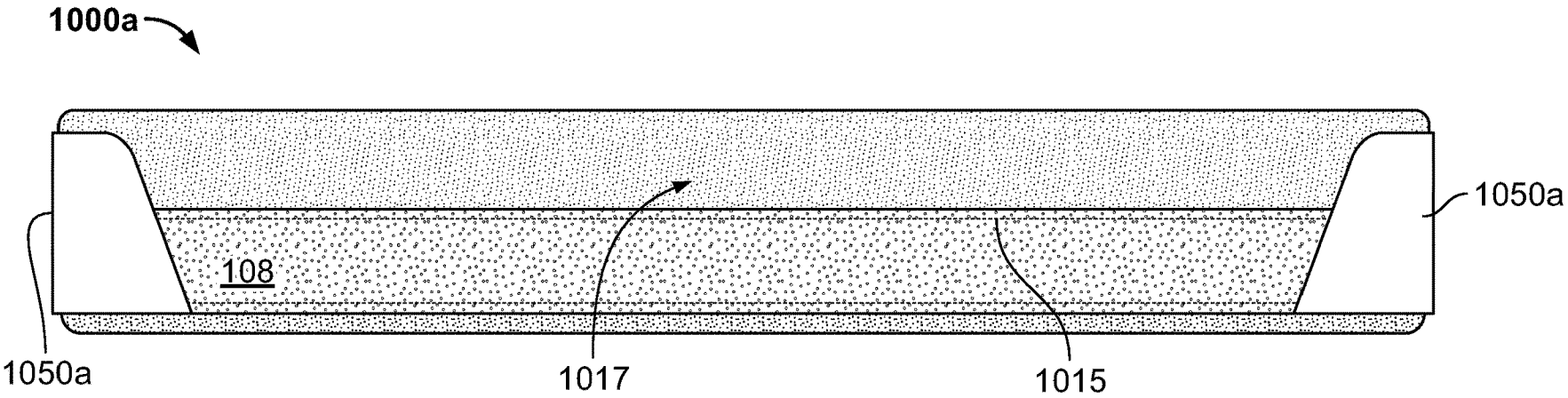
FIGS. 10A-10B are side-view schematic drawings of a mattress having an example mattress cover.
Figure 10B:
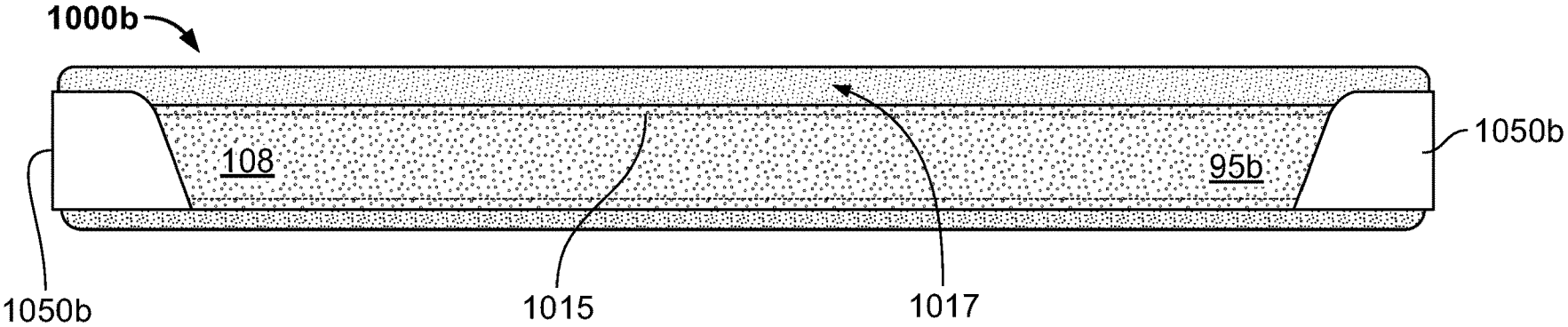

FIGS. 10A-10B are side-view schematic drawings of mattresses 95*a* and 95*b* having example mattress covers 1000*a* and 1000*b* installed over the mattresses 95*a* and 95*b*. The mattresses, 95*a* and 95*b*, and mattress covers, 1000*a* and 1000*b*, are substantially similar to the mattresses, 90*a* and 90*b*, and mattress covers, 900*a* and 900*b*, respectively, with the exception of differences described herein. FIG. 10A shows a thicker mattress 95*a* than the mattress 95*b* shown in FIG. 10B. The stretch fabric 108 remains at the same height for both of the mattresses 95*a* and 95*b*, even with a thicker mattress 95*a*. The illustrated implementations can include the stretch fabric 112, or they can include only the stretch fabric 110. The illustrated implementations have wings 1017 defined by the edge 1015 of the stretch fabric 108. These wings 1017 are similar in height and length to the mattress cover 100 illustrated in FIG. 1. In addition, both the mattress covers 1000*a* and 1000*b* include corner protectors 1050*a* and 1050*b* respectively. The corner protectors 1050*a* and 1050*b* include a third two-way stretch fabric that is configured to stretch in the vertical direction. As a thicker mattress 1000*a* is used, the height of the corner protector 1050*a* increases to match the height of the mattress 95*a* as compared to the relatively shorter mattress 95*b*. The stretch fabric 108 is kept at the same height in both of the mattresses 95*a* and 95*b*.

A number of implementations of the subject matter have been described.

Nevertheless, it will be understood that various modifications can be made without departing from the spirit and scope of the subject matter described herein. For example, in some implementations, corner protectors can be added, even if not specifically described as such. Alternatively or in addition, splits in the fabric along the perimeter can be included in any of the described implementations. Alternatively or in addition, each of the described examples can one or more fabric panels that use multidirectional stretch knits, multidirectional stretch knits with a dominant stretch direction, mono-directional stretch knits, and/or woven materials such as non-stretch woven materials. Moreover, in some implementations, various components of the mattress cover can be shaped differently than as illustrated. Additionally, different aspects of the different implementations of foundations, mattresses, and other bed system components described above can be combined with other aspects as suitable for the application. Accordingly, other implementations are within the scope of the following claims.

What is claimed is:

1. A system comprising:

a bed having a mattress with a mattress top, a mattress bottom, and a mattress perimeter, wherein the mattress comprises:

a mattress cover that is part of the mattress and that surrounds each of the mattress top, the mattress bottom, and the mattress perimeter of the mattress, the mattress cover comprising:

a first 2-way stretch fabric around the mattress perimeter of the mattress, the first 2-way stretch fabric having a stretch direction that is stretchable in a direction parallel to the mattress top and having limited or no stretch in a direction perpendicular to the mattress top;

a 4-way stretch fabric positioned on the mattress top; and a second 2-way stretch fabric positioned between the first 2-way stretch fabric and the 4-way stretch fabric, the second 2-way stretch fabric having a second stretch direction that is stretchable in a direction between an edge of the 4-way stretch fabric and an edge of the first 2-way stretch fabric, the second 2-way stretch fabric having limited or no stretch in a perpendicular direction that is perpendicular to the second stretch direction.

2. The system of claim 1, wherein the first 2-way stretch fabric and the 4-way stretch fabric each comprise knit materials having different properties from one another.

3. The system of claim 1, wherein the first 2-way stretch fabric is a woven laminated fabric.

4. The system of claim 1, wherein the second 2-way stretch fabric is at least partially on the mattress top and at least partially on the mattress perimeter.

5. The system of claim 1, wherein the mattress includes a left side and a right side, the first 2-way stretch fabric comprising a first portion along the left side that is narrower than a height of the mattress and a second portion along the right side that is narrower than the height of the mattress.

6. The system of claim 5, wherein the first portion and the second portion are the same height.

7. The system of claim 5, wherein the first portion and the second portion include a bottom portion that is in-line with a bottom side of the mattress, the second 2-way stretch fabric extending between the 4-way stretch fabric to the edge of the first 2-way stretch fabric, the second 2-way stretch fabric being both on the mattress top and at least partially along the left side and the right side.

8. The system of claim 5, wherein the first portion and the second portion each comprise a head section nearer a head of the bed and a foot section nearer a foot of the bed, each of the head sections and the foot sections having a height substantially similar to a height of the mattress.

9. A mattress cover configured to entirely surround a mattress, the mattress cover comprising:

a first two-way stretch fabric configured to be positioned around a perimeter of the mattress, the first two-way stretch fabric configured to stretch in a direction parallel to a mattress top of the mattress and that does not stretch in a direction perpendicular to the mattress top;

a four-way stretch fabric configured to be positioned on the mattress top; and a second two-way stretch fabric positioned between the first two-way stretch fabric and the four-way stretch fabric, the second two-way stretch fabric having a second stretch direction that is stretchable in a direction between an edge of the four-way stretch fabric and an edge of the first two-way stretch fabric, the second two-way stretch fabric having limited or no stretch in a perpendicular direction that is perpendicular to the second stretch direction.

10. The mattress cover of claim 9, wherein the second two-way stretch fabric is configured to be positioned at least partially on the mattress top.

11. The mattress cover of claim 9, wherein the second two-way stretch fabric is configured to stretch more than the first two-way stretch fabric and the four-way stretch fabric.

12. The mattress cover of claim 9, wherein the second two-way stretch fabric has a thicker weight knit than the first two-way stretch fabric and the four-way stretch fabric.

13. The mattress cover of claim 9, the first two-way stretch fabric comprising a first portion configured to be positioned along a left mattress side, the first portion being narrower than a height of the mattress, the first two-way stretch fabric comprising a second portion configured to be positioned along a right mattress side, the second portion being less than the height of the mattress.

14. The mattress cover of claim 13, wherein the first portion and the second portion each comprise a head section configured to be nearer a head of the mattress and a foot section configured to be nearer a foot of the mattress, each of the head sections and the foot sections having a height substantially similar to a height of the mattress.

15. The mattress cover of claim 9, wherein the mattress cover further comprises:

a bottom fabric connected to the first two-way stretch fabric and extending from a bottom edge of the perimeter to cover a mattress bottom.

16. The mattress cover of claim 15, wherein the bottom fabric comprises a non-stretch woven material.

17. The mattress cover of claim 1, wherein the first 2-way stretch fabric has the stretch direction that is stretchable in the direction parallel to the mattress top around the entire perimeter of the mattress.

18. The mattress cover of claim 1, wherein the first 2-way stretch fabric extends between the mattress top and the mattress bottom across at least a portion of the mattress perimeter.

19. A mattress defining a mattress bottom, a mattress top, and mattress sides extending perpendicularly between the mattress bottom and the mattress top, the mattress comprising:

a fabric assembly completely surrounding the mattress, the fabric assembly comprising:

a top panel positioned on the mattress top, the top panel comprising a four-way stretch fabric, the four-way stretch fabric configured to stretch only in a plane defined by the mattress top;

a bottom panel positioned on the mattress bottom, the bottom panel comprising a non-stretch fabric;

a plurality of side panels coupled to the top panel and the bottom panel, the plurality of side panels positioned on the mattress sides, the plurality of side panels each comprising a two-way stretch fabric, the two-way stretch fabric configured to stretch in a direction only between the plurality of side panels in a plane defined by the mattress sides and parallel to the mattress top and the mattress bottom, the two-way stretch fabric being non-stretchable between the mattress top and the mattress bottom; and a two-way stretch fabric positioned between the plurality of side panels and the top panel, the two-way stretch fabric having a second stretch direction that is stretchable in a direction between an edge of the top panel and an edge of the plurality of side panels, the two-way stretch fabric having limited or no stretch in a perpendicular direction that is perpendicular to the second stretch direction.

20. A fabric assembly configured to completely surround a mattress, the fabric assembly comprising:

a four-way stretch fabric, the four-way stretch fabric configured to stretch predominately in a plane corresponding to a top surface of the mattress, the four-way stretch fabric at least partially covering the top surface of the mattress;

a bottom fabric extending entirely across a bottom surface of the mattress parallel to the top surface;

a first two-way stretch fabric, the first two-way stretch fabric configured to stretch predominately in a direction of a plane defined by a side surface extending perpendicular between the top surface and the bottom surface, the direction parallel to the top surface and the bottom surface, the first two-way stretch fabric non-stretchable between the four-way stretch fabric on the top surface and the bottom fabric on the bottom surface, the first two-way stretch fabric at least partially extending between the four-way stretch fabric on the top surface and the bottom fabric on the bottom surface; and a second two-way stretch fabric positioned between the first two-way stretch fabric and the four-way stretch fabric, the second two-way stretch fabric having a second stretch direction that is stretchable in a direction between a four-way stretch fabric edge and an edge of the first two-way stretch fabric and perpendicular to the first two-way stretch fabric, wherein in second stretch direction the second two-way stretch fabric is stretchable in a direction between an edge of the four-way stretch fabric and an edge of the first two-way stretch fabric, the second two-way stretch fabric having limited or no stretch in a perpendicular direction that is perpendicular to the second stretch direction.

21. The system of claim 1, wherein the 4-way stretch fabric is positioned only on the mattress top.

22. The mattress cover of claim 9, wherein the four-way stretch fabric extends across the mattress top no farther than edges of the mattress top.

23. The mattress of claim 19, wherein the top panel is limited to the mattress top.

24. The fabric assembly of claim 20, wherein the four-way stretch fabric only covers portions of the top surface of the mattress.

* * * * *